United States Patent [19]

Simonotti et al.

[11] 4,456,234

[45] Jun. 26, 1984

[54] BANKNOTE DISPENSING MACHINE WITH DELIVERY DEVICE FOR THE RECEIPT FOR THE BANKNOTES DISPENSED

[75] Inventors: Lucio Simonotti, Banchette d'Ivrea; Aldo Ricca, Rivarolo, both of Italy

[73] Assignee: Ing. C. Olivetti & C., S.p.A., Turin, Italy

[21] Appl. No.: 513,791

[22] Filed: Jul. 15, 1983

Related U.S. Application Data

[63] Continuation of Ser. No. 242,135, Mar. 9, 1981, abandoned.

[30] Foreign Application Priority Data

Mar. 17, 1980 [IT] Italy ..... 67399 A/80

[51] Int. Cl.[3] ..... B41F 13/64

[52] U.S. Cl. ..... 270/18; 194/DIG. 26; 271/315

[58] Field of Search ..... 270/18-19, 270/58, 60; 194/DIG. 26; 235/379; 271/315, 178, 212, 181, 186, 187; 221/93, 225

[56] References Cited

U.S. PATENT DOCUMENTS

| | | | |
|---|---|---|---|
| 3,662,343 | 5/1972 | Goldstein | 194/DIG. 26 |
| 3,826,344 | 7/1974 | Wahlberg | 194/DIG. 26 |
| 4,294,380 | 10/1981 | Rankin | 194/DIG. 26 |
| 4,342,325 | 8/1982 | Lundblad | 194/DIG. 26 |

FOREIGN PATENT DOCUMENTS

| | | | |
|---|---|---|---|
| 52-56599 | 5/1977 | Japan | 194/DIG. 26 |
| 362803 | 12/1931 | United Kingdom | 221/93 |
| 2059391 | 4/1981 | United Kingdom | 271/315 |

*Primary Examiner*—E. H. Eickholt

*Attorney, Agent, or Firm*—Banner, Birch, McKie & Beckett

[57] ABSTRACT

The machine comprises a tined wheel for building the banknotes, a conveyor for presenting them to the customer through a slot, and a printer for printing the receipt. This is cut off by a blade and is guided by a system of belts, in such manner as to be fed into the wheel. The receipt is thus bundled together with the banknotes and is presented to the customer with them through the slot, avoiding the risk of the customer forgetting to collect his receipt before a vandal proof shutter closes. The printer can print a journal strip in addition to the receipt.

2 Claims, 4 Drawing Figures

BANKNOTE DISPENSING MACHINE WITH DELIVERY DEVICE FOR THE RECEIPT FOR THE BANKNOTES DISPENSED

This application is a continuation, of application Ser. No. 242,135, filed Mar. 9, 1981 and now abandoned.

BACKGROUND OF THE INVENTION

The present invention relates to an automatic banknote dispensing machine with a delivery device for the receipt for the banknotes disposed, comprising a device for bundling the banknotes to be dispensed, a dispensing mechanism adapted to convey the banknotes bundled in this way to present them to the customer through a slot in the machine, a printer for the receipt, and a device for conveying the receipt for presentation to the customer. The term "receipt" is used for simplicity to denote the document recording the transaction, i.e. documenting the receipt of the banknotes by the customer.

In known machines of the aforesaid type, the receipt is presented to the customer through a separate slot. Since the operation of such machines is controlled by the customer in possession of a credit card without the assistance of a specialised operator, it often happens that the person operating the machine withdraws the bundle of banknotes, but forgets to withdraw the receipt. Since the machine generally comprises a vandal-proof shutter which opens on insertion of the credit card and recloses automatically after the presentation of the bundle, with a minimum delay such as to allow the withdrawal of the bundle, the risk of an inexperienced customer not withdrawing the receipt is greater.

SUMMARY OF THE INVENTION

The object of the present invention is to provide a machine which is such as to obviate non-withdrawal of the receipt by the customer. This object is met by the machine according to the invention, which is characterised in that the conveying device comprises guide means adapted to convey the receipt into correspondence with the bundling device so as to be bundled and presented to the customer together with the banknotes through the slot.

BRIEF DESCRIPTION OF THE DRAWINGS

The invention will be described in more detail, by way of example, with reference to the accompanying drawings, in which:

FIG. 1 is a box diagram of the relationship between FIGS. 1*a* and 1*b;*

DESCRIPTION OF THE PREFERRED EMBODIMENT

Figure 1A:
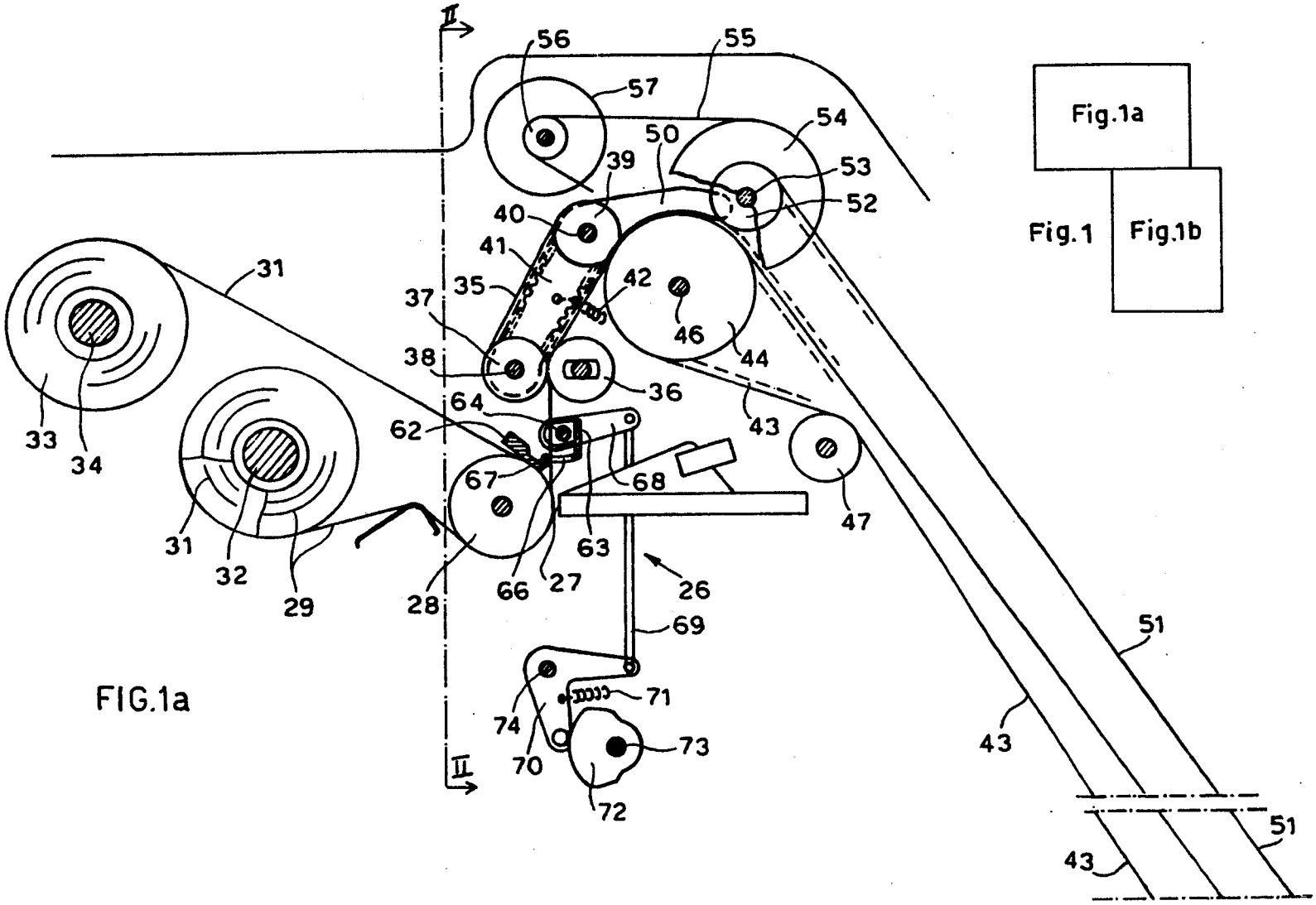
FIGS. 1*a* and 1*b* form a partial longitudinal section of a machine embodying the invention.
Figure 1B:
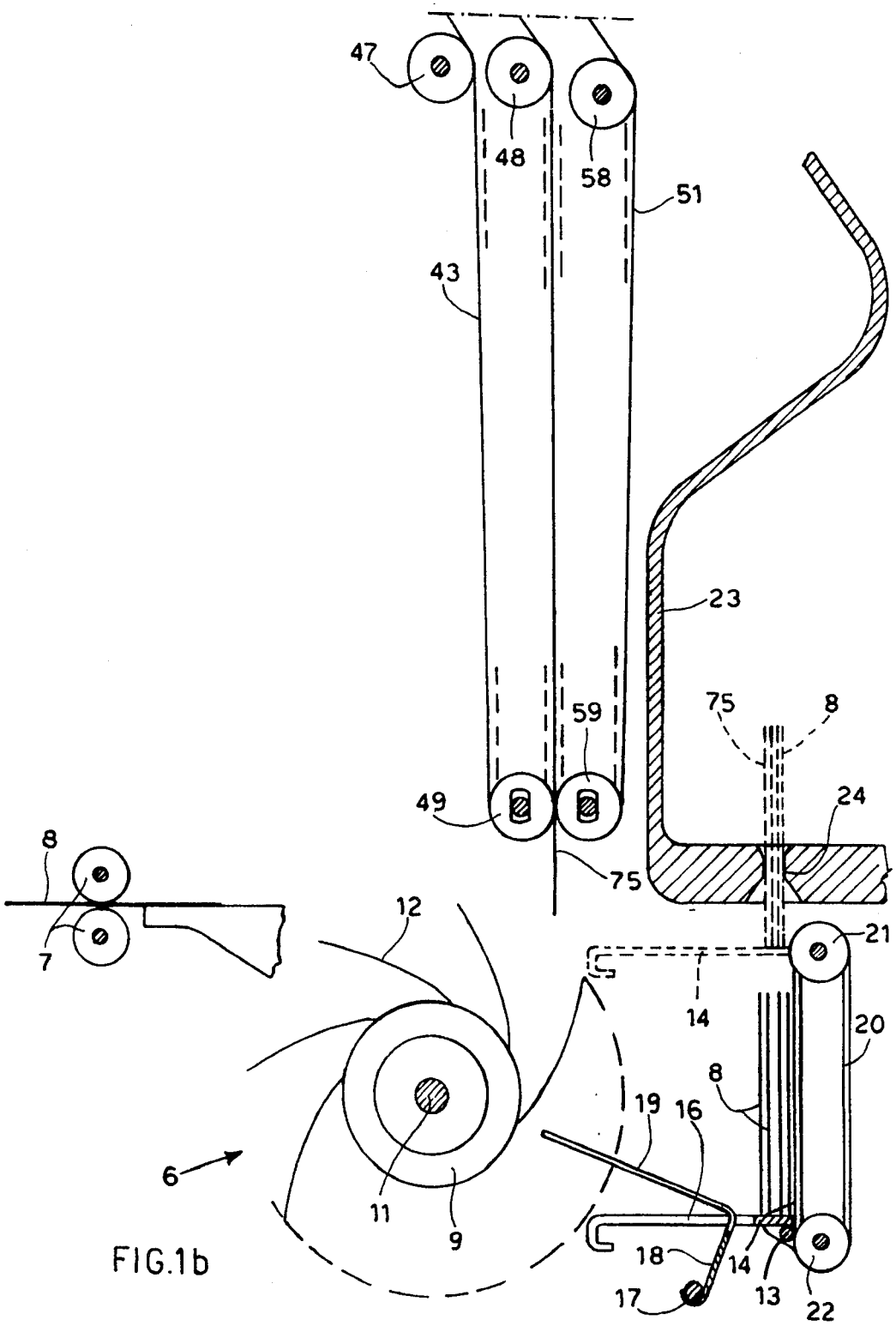

Referring to FIG. 1*b*, a device 6 for bundling the banknotes to be dispensed comprises a pair of feed rollers 7 rotatable in opposite directions so as to feed the banknotes 8, which are stripped one by one from suitable cassettes, towards two wheels 9 spaced apart on a shaft 11 which is rotatable clockwise. Each wheel 9 is provided with tines 12 which are bent substantially spirally and directed anticlockwise. The speed of the wheels 9 is such with respect to that of the rollers 7 that normally a single banknote 8 is inserted into the gap between two tines 12.

On a shaft 13 there is fixed a plate 14 adapted to intercept the banknotes 8 conveyed by the wheels 9. The plate 14 is provided with two slots 16 allowing the passage of the tines 12 of the wheels 9. On a second shaft 17 is fixed a second plate 18 having two tongues 19 at the side of the two wheels 9 and extending through the slots 16 in the plate 14. The shaft 17 is adapted to be turned clockwise to press the banknotes 8 against a vertical portion of a belt 20 by means of the tongues 19 of the plate 18. This belt passes around two pulleys 21 and 22 and carries the shaft 13. The pulley 21 can be rotated with an alternating movement so as to shift the shaft 13 vertically together with the plate 14 from the full-line position of FIG. 1*a* to the position indicated in broken lines. In this way, the plate 14 pushes the bundle of banknotes 8 up through a slot 24, presenting it to the customer, as described in DT-OS 2,653,979. The slot 24 is located in a recess 23 in the front panel of the machine and is normally protected, together with other controls, by a vandal-proof shutter not shown in the drawings, which is opened following the insertion of a credit cad into the machine and is reclosed automatically at the end of the transaction, substantially as described in the U.S. patent application Ser. No. 227,239 entitled "Apparatus for depositing and/or withdrawing Bank-notes by means of Credit Cards" filed Jan. 22, 1981.

Figure 2:
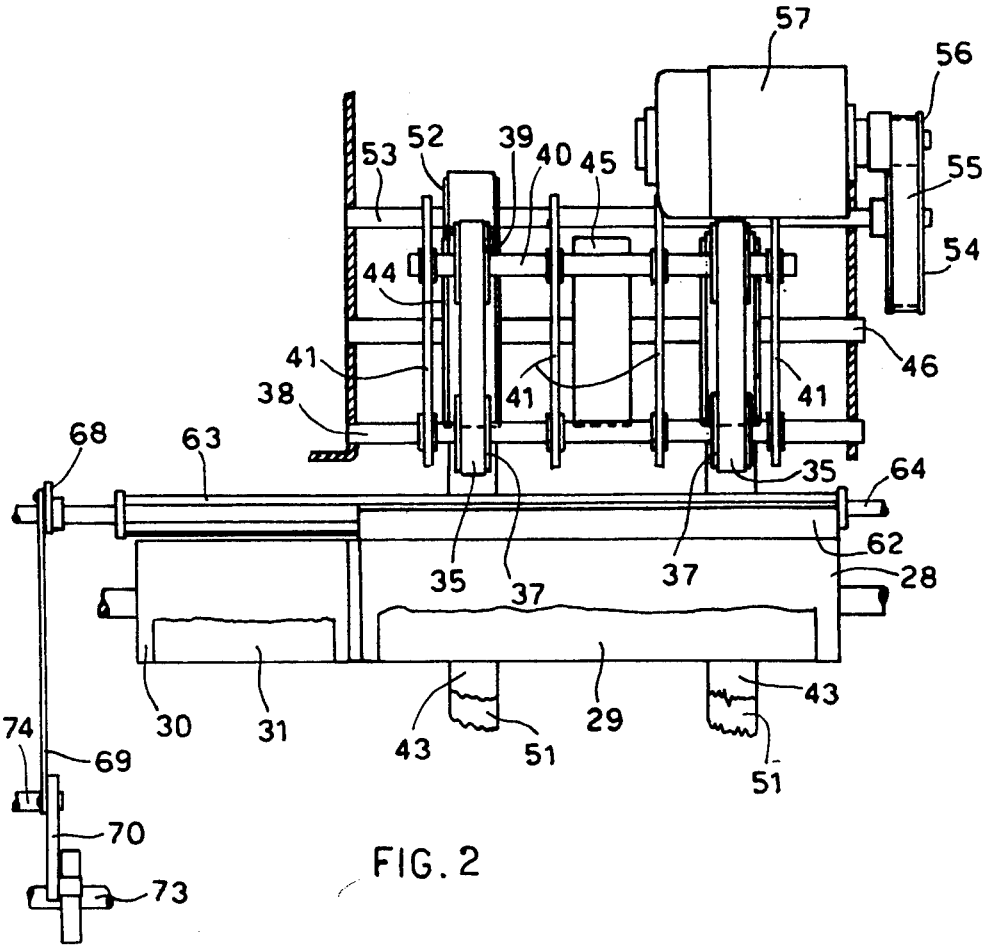
FIG. 2 is a front view on the line II—II of FIG. 1.

The machine moreover comprises a printer 26 (FIG. 1*a*) for printing a record of the operation effected. The printer 26 is of the stylus type with a vertical series of styli 27 which can be actuated selectively in such manner as to print against a platen. The platen is divided longitudinally into two parts, a long part 28 (FIG. 2) for supporting a strip of paper 29 for the receipt, and a shorter part 30 for supporting a strip 31 for the journal. The two strips 29 and 31 unwind from two feed rolls mounted on a single spindle 32 (FIG. 1*a*). The strip 31 is rewound automatically in known manner on a roll 33 on a spindle 34.

The strip 29 is inserted between two toothed belts 35 (FIG. 2) and two belt-tensioning rollers 36 (FIG. 1*a*) urged resiliently against the belts 35. Each belt 35 is passed around a pulley 37 fixed on a shaft 38 rotatable in the sides of the machine and around a second pulley 39 fixed on a shaft 40. The two shafts 38 and 40 are connected by four plates 41. The shaft 40 is urged clockwise by a spring 42 so as to keep the belts 35 bearing against two belts 43 passed around two corresponding pulleys 44 which are fixed on a shaft 46 rotatable in the sides of the machine. A wheel 45 having the same diameter as the pulleys 44 is moreover fixed on the shaft 46. The four plates 41 have an arcuate end 50 (FIG. 1*a*) so as to guide the receipts around the pulleys 44 and the wheel 45. The belts 43 are moreover guided by rollers 47 and 48 and are passed around two rollers 49 (FIG. 1*b*) which are urged downward resiliently and have the function of belt tensioners. The belts 43 cooperate with two driving belts 51 passed around two driving pulleys 52 fixed on a shaft 53 (FIG. 1*a*) rotatable in the sides of the machine. On the shaft 53 there is fixed another pulley 54 adapted to be rotated, through the medium of a belt 55 and a pulley 56, by an electric motor 57. The belts 51 are moreover guided by rollers 48 and 58 (FIG. 1*b*) and are passed around two belt-tensioning rollers 59 disposed alongside the rollers 49. The rollers 49 and 59 are arranged substantially above the wheels 9 in a position such as to allow the latter to bring the receipt into the position of bundling with the banknotes 8.

Between the platen 28 and the belts 35 there is disposed a device for cutting the receipt strip 29, this device comprising a fixed bar 62 and a blade 63 fixed on a shaft 64 rotatable in the sides of the machine. The blade 63 has a cutting edge 66 inclined with respect to the edge 67 of the bar 62. An arm 68 connected by means of a tie rod 69 to a lever 70 pivoted on a fixed pin 74 is fixed on the shaft 64. The lever 70 is adapted to cooperate by the action of a spring 71 with a cam 72 on a cyclically rotatable shaft 73.

The machine described operates in the following manner. After the preliminary checking operations effected on the credit card by the machine, the vandal-proof shutter is opened and the motor 57 is set in operation and, through the medium of the belt 55, sets the belts 51 in motion and, therefore, also the belts 43 and the belts 35. Moreover, the rollers 7 and the shaft 11, together with the wheels 9, are set in rotation. After entry on a keyboard of the amount to be drawn, the machine begins to strip off and count the banknotes 8 of the desired denominations under the control of a central unit (not shown). The banknotes 8 are then fed between the two rollers 7 of the bundling device 6, which push them individually between the tines 12 of the wheels 9. After a rotation of about 90° with the wheels 9, each banknote 8 is arrested by the plate 14, as a result of which the bundle of banknotes is packed between the belt 20, the plate 14 and the wheels 9.

Simultaneously, the shaft 73 is rotated and, through the medium of the cam 72, the lever 70 and the tie rod 69, causes the blade 63 to open up. The platen 28 is now rotated so as to cause the top edge of the strip 29, previously cut by the blade 63, to engage between the rollers 36 and the belts 35. The printer 26 then prints on the strip 29 the details of the cash withdrawal required for the receipt, including the data read on the credit card, while it prints on the strip 31 the data required for the journal.

During the printing of the various lines of the transaction, the strip 31 of the journal is wound on the rewinding roll 33, while the strip 29 is conveyed by the belts 35 and by the arcuate ends 50 between the two pairs of belts 43 and 51. At the end of the printing operation, the platen 28 is rotated so as to allow the separation of one transaction from another on the strip 29 and the cutting off of the receipt. Through the medium of the cam 72, the shaft 73 then causes the lever 70 to turn clockwise. By means of the tie rod 69 and the arm 68, the lever 70 causes the shaft 64 to turn clockwise together with the blade 63, as a result of which the receipt is cut off. While the cam 72 causes the blade 63 to return to reset, the belts 35, 43 and 51 rapidly carry the detached receipt off downwardly until it leaves the belts between the rollers 49 and 59. The receipt 75 thus drops between two tines 12 of the wheels 9 and is bundled beside the banknotes 8 on the plate 14. The shaft 17 is then rotated, as a result of which the plate 18 presses the receipt 75, together with the banknotes 8, against the belt 20, forming the bundle for the customer. The pulley 21 is now rotated clockwise through a clutch (not shown) so as to cause the bundle to be pushed up by the belt 20 and the plate 14 until it projects out of the slot 24 to be presented to the customer, as a result of which the customer withdraws both the banknotes 8 and the receipt 75 in a single operation. After a predetermined delay, the pulley 21 is rotated in the opposite direction, bringing the plate 14 into the rest or inoperative position, while the vandal-proof shutter is closed and the machine stops.

Among various modifications which may be made in the described machine, the tines of the wheels 9 may have a form different from that indicated, the printer may be provided with a single platen and the two strips 29 and 31 may be superposed to print the receipt and the journal by a transfer method, and so on.

We claim:

1. An automatic banknote dispensing machine having a delivery device for a transaction receipt reporting information with respect to the transaction effected in dispensing the banknotes, comprising: a bundling device having at least one tined wheel adapted to receive sequentially the counted banknotes to be dispensed and to bundle them on a substantially vertical flat support located in correspondence with a predetermined angular position of said wheel, a dispensing mechanism adapted to convey the bundled banknotes to present them to the customer through a slot in the machine, a serial printer for printing a transaction receipt, a device for conveying the transaction receipt for presentation to the customer, said conveying device comprising a pair of continuously movable belts disposed between said printer and said tined wheel so as to bundle and present the transaction receipt to the customer together with the banknotes through said slot, characterized in that said belts define a path for said receipt including a substantially vertical end portion adjacent to said flat support and wherein the receipt is moved downwards, said slot being located directly over said flat support, said dispensing mechanism conveying said banknotes bundled with said transaction receipt toward said slot by moving them, accurately aligned together, upwards along said flat support.

2. An automatic banknote dispensing machine having a delivery device for a receipt reporting information with respect to the transaction effect in dispensing the banknotes, comprising: a bundling device having at least one tined wheel adapted to receive sequentially the counted banknotes to be dispensed and to bundle them on a support belt having a substantially vertical portion located in correspondence with a predetermined angular position of said wheel, a dispensing mechanism adapted to convey the bundled banknotes to present them to the customer through a slot in the machine, a serial printer for printing the receipt on a print strip in a plurality of parallel lines, a cutting device operable for cutting said strip parallel to said lines to form a cut receipt, a device for conveying the cut receipt for presentation to the customer, said conveying device comprising means for turning said cut receipt upside-down and a pair of continuously movable belts disposed between said turning means and said tined wheel so as to bundle and present the cut receipt to the customer together with the banknotes through said slot, said belts defining a path for said cut receipt including a substantially vertical end portion wherein the receipt is moved downwards, said slot being located directly over the vertical portion of said support belt, said dispensing mechanism conveying said banknotes bundled with said receipt toward said slot by moving them vertically upwards along said support belt.

* * * * *